US007116543B2

(12) United States Patent
Kim et al.

(10) Patent No.: US 7,116,543 B2
(45) Date of Patent: Oct. 3, 2006

(54) APPARATUS FOR SUPPLYING ELECTRIC ENERGY TO EXPLOSION CARTRIDGE

(75) Inventors: Hee Jin Kim, Kyunggi-do (KR); Tae Yong Shin, Kyunggi-do (KR); Hyo Jin Ahn, Kyunggi-do (KR)

(73) Assignee: Vitzrotech Co. Ltd., Kyunggi-do (KE)

( * ) Notice: Subject to any disclaimer, the term of this patent is extended or adjusted under 35 U.S.C. 154(b) by 427 days.

(21) Appl. No.: 10/448,822

(22) Filed: May 30, 2003

(65) Prior Publication Data

US 2004/0240143 A1 Dec. 2, 2004

(51) Int. Cl.
*F23Q 7/00* (2006.01)

(52) U.S. Cl. ..... 361/251

(58) Field of Classification Search ..... 361/251
See application file for complete search history.

(56) References Cited

U.S. PATENT DOCUMENTS 3,537,399 A * 11/1970 Miller ..... 102/218
3,715,614 A * 2/1973 Linkroum ..... 313/568
4,601,243 A * 7/1986 Ueda et al. ..... 102/200
4,848,232 A * 7/1989 Kurokawa et al. ..... 102/200

* cited by examiner

*Primary Examiner*—Brian Sircus
*Assistant Examiner*—Boris Benenson
(74) *Attorney, Agent, or Firm*—Butzel Long

(57) ABSTRACT

An electric power supplying apparatus for a rock explosion cartridge is disclosed. The apparatus includes the following elements. A power source generates an electric energy. A plurality of channels consist of capacitors for storing an electric energy from the power source, explosion cartridges for being exploded by the electric energies of the capacitors, and input switches for switching the capacitors. A controller controls the turning-on/off of the input switches of the plurality of the channels, and the plurality of the channels are connected to the controller in parallel. There are further included the following elements. That is, a charging switch switches a connection between the power source and the capacitor. A discharging resistor is connected to the capacitor in parallel, and a discharging switch switches a connection between the capacitor and the discharging resistor, while the controller controls the turning-on/off of the charging and discharging switches.

8 Claims, 4 Drawing Sheets

APPARATUS FOR SUPPLYING ELECTRIC ENERGY TO EXPLOSION CARTRIDGE

FIELD OF THE INVENTION

The present invention relates to an electric power supplying apparatus for a rock explosion cartridge in which the cartridge is exploded by an electric glow discharge in the civil construction works.

More specifically, the present invention relates to an electric power supplying apparatus for a rock explosion cartridge in which a main controller controls an input switch, a discharging switch and a charging switch so as to make one or more explosion cartridges exploded sequentially, while the charges and discharges are automatically carried out in the civil construction works.

BACKGROUND OF THE INVENTION

In the pulse power system which is for exploding the rocks in the civil construction works, there is accumulated a high voltage electric energy to release it momentarily so as to explode the rock.

As shown in FIG. 1, this industrial pulse power system includes: a commercial power source 1 for generating the electric energy; a rectifier 2; an energy storing capacitor 3 for storing the charges; a charging switch 10 for switching the connection between the power source to the capacitor; an explosion cartridge 5 for causing a momentary explosion by receiving the stored energy from the capacitor; and a mechanical input switch 4 for switching the connection between the capacitor to the explosion cartridge.

In this conventional industrial pulse power system, the explosion cartridge 5 in which an electrolyte is contained is inserted into a drilled hole. Then a high-density electric energy which has been charged into the capacitor 3 from the power source 1 is momentarily supplied to the explosion cartridge, so that the cartridge is exploded to explode the rock.

However, in the conventional pulse power system, the mechanical input switch 4 is used to ignite the explosion cartridge 5, and therefore, it was not suitable for the case where a plurality of explosion cartridges have to be exploded at infinitesimal time intervals at a plurality of positions on the rock.

That is, if the rock to be exploded is considerably large, a plurality of holes are drilled into the rock, and an explosion cartridge 50 is inserted into each of the drilled holes. Then the plurality of the cartridges are exploded sequentially at infinitesimal time gaps (e.g., time gaps of several ms).

Under this condition, as the time gap is smaller, so much easier are the explosions of the rock even with a small amount of explosion energy. However, the conventional mechanical input switch 40 is such that the contact time of the movable switch contacting to the fixed switch is not constant. Accordingly, the precision of several ms cannot be satisfied.

Further, in the conventional pulse power system, the stored electric energy is not totally consumed in the explosion, but there remain residual energies. If the circuit is subjected to a short circuit by disregarding the residual energy, then an electric spark can be generated, and this can lead men to a serious burning or a visual loss.

SUMMARY OF THE INVENTION

Therefore, it is an object of the present invention to provide an electric power supplying apparatus for a rock explosion cartridge in which a plurality of the cartridges are sequentially exploded.

It is another object of the present invention to provide an electric power supplying apparatus for a rock explosion cartridge in which a plurality of the cartridges are sequentially exploded at infinitesimal time gaps.

It is still another object of the present invention to provide an electric power supplying apparatus for a rock explosion cartridge in which people are protected from the danger of the residual electric energy after the explosion.

It is still another object of the present invention to provide an electric power supplying apparatus for a rock explosion cartridge in which charge and discharge to and from the capacitor are automatically carried out.

It is still another object of the present invention to provide an electric power supplying apparatus for a rock explosion cartridge in which a power source for the capacitor is internally equipped.

The above objects and other objects can be achieved by the present invention described below.

A first characteristic of the present invention is that a controller sends electrical signals to respective input switches based on predetermined time gaps so as to explode a plurality of channels sequentially at infinitesimal time gaps.

In order to achieve this, the electric power supplying apparatus according to the present invention includes: a sequence timer or a controller connected to high voltage generators of an igniting electrodes for respective explosion cartridges of a plurality of channels, whereby the controller makes the igniting electrodes activated through the high voltage generator at predetermined time gaps.

A second characteristic is that the explosion cartridges can be made selectively exploded among the plurality of the channels in the first characteristic of the above electric power supplying apparatus.

In order to achieve this, the electric power supplying apparatus according to the present invention is such that the sequence timer or the controller is connected to respective charging switches of the plurality of the channels, and the charging switches are turned on only for the channels to be exploded.

A third characteristic of the present invention is that the possible disaster of the residual electric energy in the capacitor after the explosion of the cartridge can be prevented.

In order to achieve this, the electric power supplying apparatus according to the present invention is such that discharging resistors are connected to the capacitors in parallel, and after the explosions, the controller completely discharges the residual energies from the capacitors after elapse of a certain period of time.

A fourth characteristic of the present invention is that the charges and discharges of the capacitors based on the third characteristic are made not to occur simultaneously. In order to achieve this, the electric power supplying apparatus according to the present invention is such that the charging and discharging switches are not simultaneously turn on, but one of the pair is turned off during the turn-on of the other, by the function of the controller on a predetermination basis.

A fifth characteristic of the present invention is that the input switch is a vacuum gap type switch in the first characteristic of the electric power supplying apparatus.

That is, this vacuum type input switch includes: a pair of main electrodes; an igniting electrode connected to one of the pair of the main switches; an insulated vacuum vessel for sealing the pair of the main switches and the igniting switch; and a high voltage generator for supplying a high voltage to the igniting electrode.

BRIEF DESCRIPTION OF THE DRAWINGS

The above objects and other advantages of the present invention will become more apparent by describing in detail the preferred embodiment of the present invention with reference to the attached drawings in which.

DETAILED DESCRIPTION OF THE PREFERRED EMBODIMENT

The electric power supplying apparatus for a rock explosion cartridge according to the present invention will be described in detail referring to the attached drawings.

Figure 1:
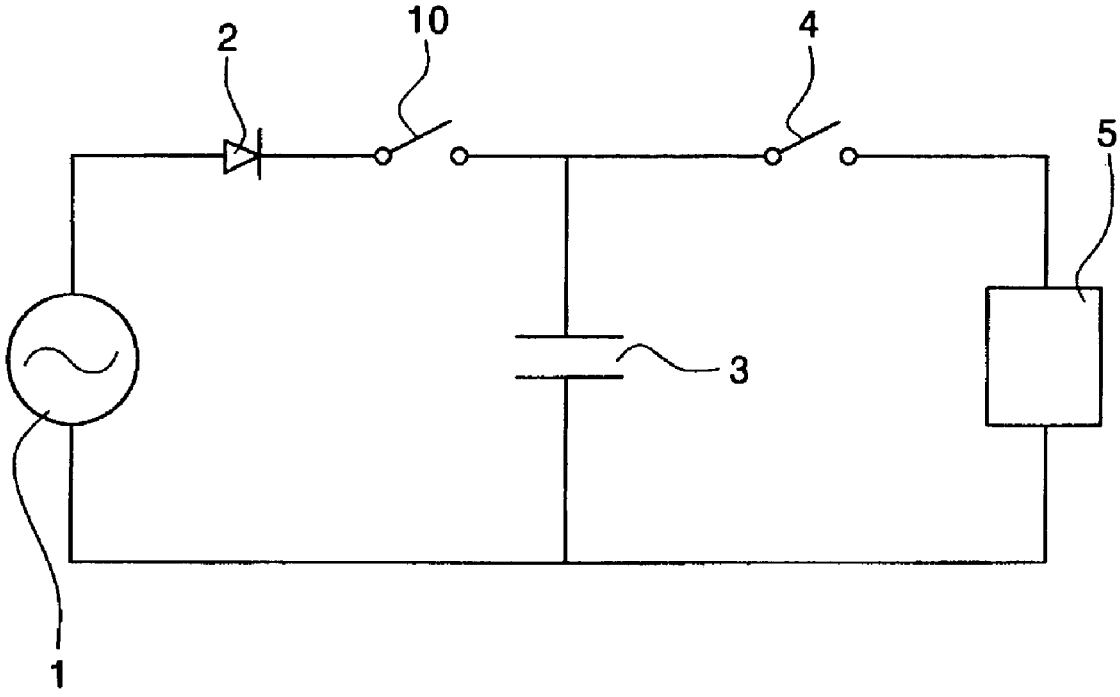
FIG. 1 is a circuit diagram schematically showing the constitution of a rock exploding pulse power system.
Figure 2:
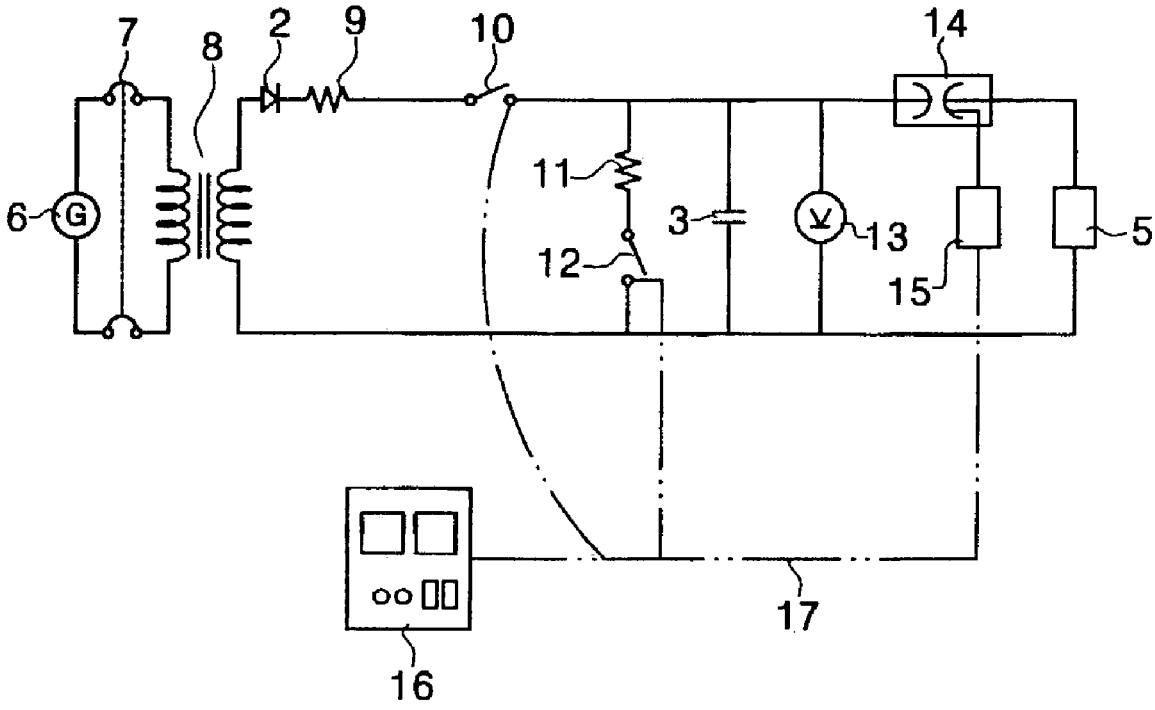
FIG. 2 is a circuit diagram schematically showing the electric power supplying apparatus for the rock explosion cartridge according to the present invention.
Figure 3:
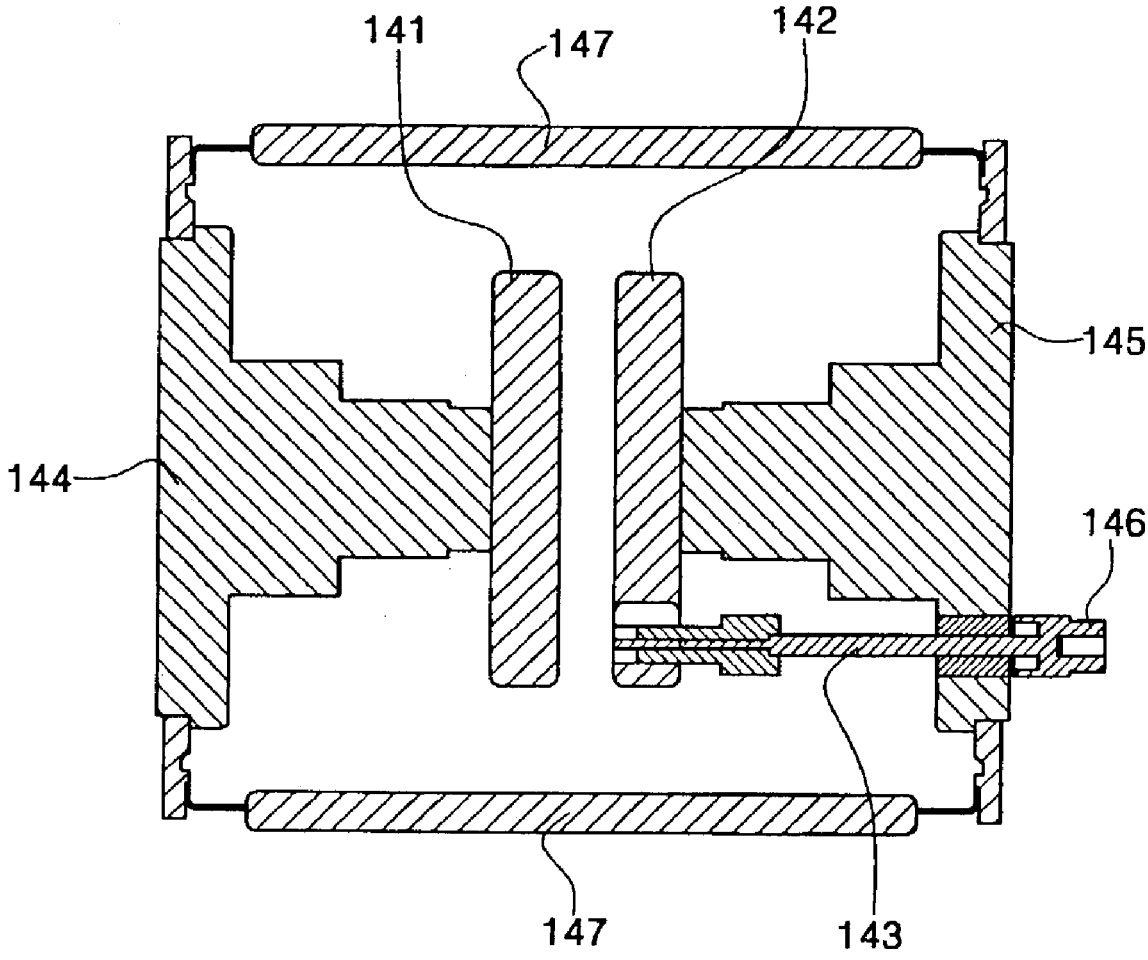
FIG. 3 is a schematic sectional view of a vacuum gap type input switch.

FIG. 2 is a circuit diagram schematically showing the electric power supplying apparatus for the rock explosion cartridge according to the present invention. FIG. 3 is a schematic sectional view of a vacuum gap type input switch.

The electric power supplying apparatus for a rock explosion cartridge according to the present invention includes: a power source (generally an ac power source) 1 for generating an electric energy; a transformer 8 for stepping up the electric energy of the power source to form a high voltage; a power source switch 7 for switching a line between the transformer and the power source; a rectifier 2 for rectifying the high voltage of the transformer into a direct electric current; a capacitor 3 for storing an electric energy; and an input switch 14 for switching a line between the capacitor 3 and a cartridge 5.

When storing the electric energy into the capacitor, if an excessive charging current momentarily flows, then the excessive electric current also flows within the power source and the transformer, and therefore, a disorder may occur in them.

Accordingly, in order to limit the electric current, there is inserted a charging current limiting resistor 9 between the transformer and the capacitor in series. The high voltage electric energy is momentarily supplied from the capacitor to the detonator of the cartridge so as to make the cartridge exploded. This explosion energy explodes the rock.

The electric power supplying apparatus according to the present invention has an ac electric generator, and this solves the problem that generally at the civil construction work sites, an external power source is not available.

Meanwhile, a voltage-measuring device 13 may be attached to the capacitor in parallel so as to measure the charge level of the capacitor. Thus the charge level of the capacitor can be directly indicated, or an internal processor may display a converted value of the charge level.

The electric energy which has been stored in the capacitor is supplied through the input switch 14 into the explosion cartridge 5.

As shown in FIG. 2, the input switch according to the present invention includes: an insulated vacuum vessel 147; a pair of main electrode blocks 144 and 145; and a pair of main electrodes 141 and 142 made of a special metal and facing toward each other.

The pair of the main electrodes are supported by the pair of the main electrode blocks 144 and 145 respectively. Meanwhile, the main electrode blocks are connected to an anode and a cathode of the capacitor 3 respectively. Accordingly, one of the main electrodes serves as the anode, while the other one serves as the cathode.

Further, an igniting electrode 143 is installed on any one of the pair of the main electrodes, so that a vacuum arc would occur between the pair of the main electrodes.

The igniting electrode 143 produces a glow discharge or an arc by the high voltage which is generated by a high voltage generator 15, the high voltage generator 15 being connected to an igniting electrode block 146.

Between the two main electrodes, there is built up a high potential difference owing to the charged capacitor 3. When the glow discharge or arc occurs, an insulator breakdown is caused between the two main electrodes. Accordingly, an electric current flows between the two main electrodes 141 and 142, and this is also called "electric input".

Owing to the electric current flowing between the two main electrodes, a large electric current momentarily flows through the explosion cartridge 5, and therefore, the cartridge is exploded by the electric energy. As described above, a high pressure is produced within the rock, thereby exploding the rock.

As described above, in the input switch of the present invention, if the high voltage generator 15 is turned on, an electric current flows between the two main electrodes momentarily without any actual delay, and at the same time, the cartridge 5 is exploded.

In the case of the conventional mechanical switch, even if the controller supplies the electrical signals, there occurs a time delay (about several ms) because time is consumed when the movable contact moves to the fixed contact.

In contrast to this, the input switch (to be called "vacuum gap type switch" below) of the present invention does not cause any time delay. That is, if the controller 16 supplies electrical signals, an electric input into the explosion cartridge 5 instantly occurs owing to the high voltage generator 15 and the vacuum gap type switch 14 without any actual time delay.

The electric power supplying apparatus according to the present invention further includes: a discharging switch 12 and a discharging resistor 11 connected in parallel to the capacitor 3. That is, if the discharging switch is at a turned-on status, the electric energy which has been stored in the capacitor is all discharged through the discharging resistor in the form of thermal energy and the like.

The electric power supplying apparatus according to the present invention further includes: a charging switch 10 disposed between the power source and the capacitor in series to them. Only when the charging switch is at a turned-on status, the capacitor can store the electric energy from the power source. The charging and discharging switches are turned on/off by the controller 16 on a predetermination basis.

Desirably, after the explosion of the cartridge 5, the controller maintains the discharging switch at the turned-on status for a certain short period of time so that the residual electric energy of the capacitor would be completely discharged through the discharging resistor 11.

Further, the controller ensures that the charging switch 10 and the discharging switch 12 are turned on not simultaneously.

That is, when the electric energy is being stored into the capacitor 3, the charging switch is turned on, while the discharging switch is turned off. On the other hand, during the time when the residual electric energy is being discharged from the capacitor 3, the charging switch is turned off, while the discharging switch is turned on.

Further, when the charging of the capacitor is completed, both the charging switch 10 and the discharging switch 12 are turned off, while the vacuum gap type switch 14 is turned on (to make the electric current flow).

That is, if it is confirmed that the capacitor has been charged with a sufficient voltage or electric energy, then the controller turns off the charging and discharging switches all.

After the charging and discharging switches are turned off, the electric energy of the capacitor is inputted through the vacuum gap type switch into the explosion cartridge.

For this purpose, a voltage-measuring device 13 is connected through a separate control line (not illustrated) to the controller. If it is recognized that the measured voltage or electric energy is sufficient (that is, if a predetermined threshold value is exceeded), then the controller turns off the charging and discharging switches.

In another alternative, regardless of the voltage-measuring device, if a predetermined time period elapses after the turning-on of the charging switch, the controller automatically turns off the charging and discharging switches.

If the rock to be exploded is considerably large, one single explosion of the cartridge 5 will not be sufficient. Therefore, in this case, a plurality of holes are drilled, and a plurality of explosion cartridges 5 are inserted to explode them sequentially at infinitesimal time gaps (e.g., several ms to several seconds), thereby effectively exploding the rock.

That is, the electric energies are supplied sequentially at infinitesimal time gaps to the plurality of the explosion cartridges 5. For this purpose, the electric power supplying apparatus according to the present invention employs a vacuum gap type input switch 14 and a sequence timer or controller 16 (to be called "controller" below).

That is, the controller 16 transmits signals through a control cable 17 to the high voltage generator 15 at predetermined time gaps, so that the high voltage generator would generate high voltages in pulse forms. This high voltage pulse is supplied to an igniting electrode 143 of the vacuum gap type input switch, and thus, a small glow discharge occurs at the main electrode 142.

This glow discharge destroys the insulating medium between the two main electrodes 142 and 143, and therefore, the electric energy of the capacitor 3 flows between the two main electrodes in a form of an electric current.

In the electric power supplying apparatus of the present invention, there is not involved any mechanical element in the process of exploding the explosion cartridge 5 by the input switch 14, but there are involved only the electrical actions. Accordingly, the plurality of the explosion cartridges 5 can be exploded sequentially at infinitesimal time gaps without any actual time delay.

Figure 4:
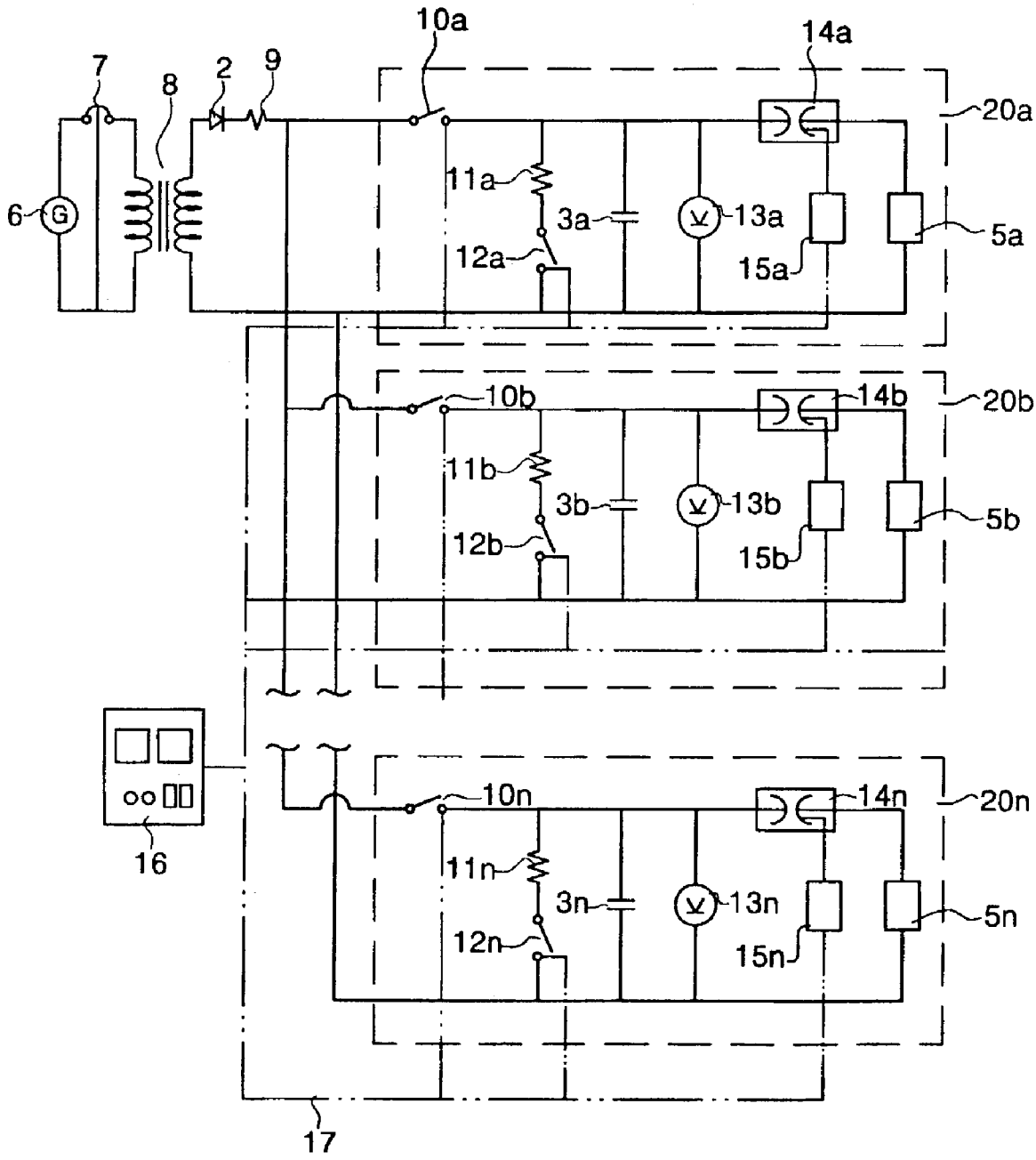
FIG. 4 is a circuit diagram specifically showing a plurality of electric power supplying apparatuses employed for the rock explosion cartridge according to the present invention.

FIG. 4 is a circuit diagram showing another embodiment of the present invention in which a plurality of the explosion cartridges are employed to the electric power supplying apparatus.

In this embodiment, a plurality of channels 20*a*, 20*b*, . . . , 20*n*, (shown in dotted lines) are connected to the power source in parallel, and the power source includes: an ac electric generator 6, a power source switch 7, a transformer 8, a rectifier, and a charging current limiting resistor 9.

The number of the channels (n channels in the drawing) corresponds to the number of the explosion cartridges 5*a*, 5*b*, . . . , 5*n*, and so many holes are drilled into the rock.

The channels basically include: capacitors 3*a*, 3*b*, . . . , 3*n* for storing the electric energies; vacuum gap type switches 14*a*, 14*b*, . . . 14*n* for switching the connections between the capacitors and explosion cartridges 5*a*, 5*b*, . . . , 5*n*; and high voltage generators 15*a*, 15*b*, . . . , 15*n* for supplying the high voltages to the ignition electrodes of the vacuum gap type switches.

Further, voltage-measuring devices 13*a*, 13*b*, . . . , 13*n* can be connected to the respective capacitors in parallel, for measuring the charged voltages or energies of the capacitors.

The high voltage generators are connected through a plurality of control cables 17 (shown in two-dot chain lines) to the controller 16. That is, the controller transmits electrical signals to the respective high voltage generators at predetermined time points, and thus, the respective vacuum gap type switches are turned on, thereby exploding the explosion cartridges 5*a*, 5*b*, . . . , 5*n*.

Preferably, charging switches 10*a*, 10*b*, . . . , 10*n* are provided between the respective channels and the power source part. Further, the charging switches are connected to the controller 16 so as to be turned on/off based on the predetermined plan as inputted in the controller.

Accordingly, the user can turn on only certain particular charging switches selectively, and thus, only the desired channels can be used among the plurality of the channels (n channels).

More preferably, between the capacitors and the power source part, there are connected in parallel a plurality of discharging resistors 11*a*, 11*b*, . . . , 11*n* and a plurality of discharging switches 12*a*, 12*b*, . . . , 12*n* for switching the resistors respectively.

As described above, the discharging resistors are for discharging the residual electric energies which remain in the capacitors after the explosion of the explosion cartridges 5*a*, 5*b*, . . . , 5*n*.

The respective discharging switches are connected through the control cables 17 to the controller 16, and are turned on or off by the controller 16. Under this condition, when a certain time has been elapsed after the explosion of the cartridges, the controller turns on the respective discharging switches.

Necessarily, the controller ensures that the charging switches 10*a*, 10*b*, . . . , 10*n* and the discharging switches 12*a*, 12*b*, . . . , 2*n* are turned on not simultaneously.

That is, during the time when the respective capacitors 3*a*, 3*b*, . . . , 3*n* are storing the electric energies, the respective charging switches are turned on, while the respective discharging switches are turn off. On the other hand, during the time when the respective capacitors 3*a*, 3*b*, . . . , 3*n* are discharging the residual electric energies, the respective charging switches are turned off, while the respective discharging switches are turn on.

In controlling the high voltage generators 15*a*, 15*b*, . . . , 15*n*, the charging switches 10*a*, 10*b*, . . . , 10*n* and the discharging switches 12*a*, 12*b*, . . . , 12*n*, there can be employed a controller in which a sequence timer or a microprocessor is internally installed.

Further, the controller may be equipped with a user interface, so that the user can directly turn on/off the elements (the switches and the like). Or it can be arranged that a microprocessor automatically turn on/off the elements at predetermined time points.

If the respective capacitors 3*a*, 3*b*, . . . , 3*n* are fully charged, then the charging switches 10*a*, 10*b*, . . . , 10*n* and the discharging switches 12*a*, 12*b*, . . . , 12*n* are all turned off, thereby becoming ready for explosion task. Further, the vacuum gap type switches 14*a*, 14*b*, . . . 14*n* are ready for inputting the electric energies.

For this purpose, as described above, the respective voltage-measuring devices 13*a*, 13*b*, . . . , 13*n* are connected through separate control lines (not illustrated) to the controller. If the measured voltages or electric energies as measured by the voltage-measuring devices are found to be sufficient (that is, if exceeds the predetermined threshold value), then the charging and discharging switches are all turned off.

In another alternative, if the predetermined time period is elapsed after the turning-on of the charging switches, then the controller turns off the charging and discharging switches regardless of the measurements of the voltage-measuring devices.

According to the present invention as described above, at least one or more explosion cartridges are exploded sequentially at infinitesimal time gaps, and the capacitors are charged from an internally installed power source, while the capacitors for supplying the electric energies to the explosion cartridges are automatically charged and discharged. Therefore, the residual electric energies are all dissipated, thereby protecting the humans from electric shocks.

In the above, the present invention was described based on the specific preferred embodiments and the attached drawings, but it should be apparent to those ordinarily skilled in the art that various changes and modifications can be added without departing from the spirit and scope of the present invention, which will be defined in the appended claims.

What is claimed is:

1. An electric power supplying apparatus for a rock explosion cartridge, comprising:

a power source for generating an electric energy;

a plurality of channels consisting of: capacitors for storing an electric energy from the power source;

explosion cartridges for being exploded by the electric energies of the capacitors;

input switches for switching the capacitors; and a controller for turning on/off the input switches of the plurality of the channels; and the plurality of the channels being connected to the controller in parallel, wherein the input switch comprises:

a pair of main electrodes facing to each other;

a pair of main electrode blocks connected to the main electrodes respectively, for supporting the main electrodes respectively;

an igniting electrode connected to any one of the two main electrodes;

an igniting electrode block connected to the igniting electrode;

an insulated vessel for sealing the pair of the main electrodes and the igniting electrode in vacuum;

a high voltage generator for supplying a high voltage through the igniting electrode block to the igniting electrode; and the main electrodes being connected through the main electrode blocks to the capacitor, and the controller turning on/off the high voltage generator so as to turn on/off the input switch.

2. The electric power supplying apparatus as claimed in claim 1, wherein each of the channels comprises:

a charging switch for switching a connection between the power source and the capacitor;

a discharging resistor connected in parallel to the capacitor;

a discharging switch for switching a connection between the capacitor and the discharging resistor; and the controller turning on/off the charging and discharging switches.

3. The electric power supplying apparatus as claimed in claim 2, wherein any one of the charging and discharging switches is turned on, and another is turned off, by the controller.

4. The electric power supplying apparatus as claimed in claim 1, wherein the controller supplies electrical signals at a predetermined time point to realize an electrical connection between the capacitor and the explosion cartridge.

5. An electric power supplying apparatus for a rock explosion cartridge, comprising:

a power source for generating an electric energy;

a capacitor for storing the electric energy from the power source;

an input switch for switching a connection between the capacitor and explosion cartridge for being exploded by the electric energy of the capacitor;

a controller for turning on/off the input switch; and the input switch consisting of:

a pair of oppositely facing main electrodes;

an igniting electrode connected to any one of the main electrodes; and an insulated vessel for sealing the pair of the main electrodes and the igniting electrode in vacuum, the controller turning on/off the high voltage generator to turn on/off the input switch.

6. The electric power supplying apparatus as claimed in claim 5, further comprising:

a charging switch for switching a connection between the power source and the capacitor;

a discharging resistor connected to the capacitor in parallel;

a discharging switch for switching a connection between the capacitor and the discharging resistor, and the controller turning on/off the charging and discharging switches.

7. The electric power supplying apparatus as claimed in claim 6, wherein any one of the charging and discharging switches is turned on, and another is turned off, by the controller.

8. The electric power supplying apparatus as claimed in claim 5, wherein the controller supplies electrical signals at a predetermined time point to realize an electrical connection between the capacitor and the explosion cartridge.

* * * * *

UNITED STATES PATENT AND TRADEMARK OFFICE

CERTIFICATE OF CORRECTION

PATENT NO. : 7,116,543 B2
APPLICATION NO. : 10/448822
DATED : October 3, 2006
INVENTOR(S) : Hee Jin Kim, Tae Yong Shin and Hyo Jin Ahn It is certified that error appears in the above-identified patent and that said Letters Patent is hereby corrected as shown below:

Title page, item [73]
Assignee country code should be changed from (KE)
to
--(KR)--

Item [75]

Inventors to be changed from

Hee Jin Kim, Kyunggi-do (KR); Tae Yong Shin, Kyunggi-do (KR);
Hyo Jin Ahn, Kyunggi-do (KR)

to

--Hee Jin Kim, Kyunggi-do (KR); Tae Yong Shin, Kyunggi-do (KR);
Hyo Jin Ahn, Kyunggi-do (KR); Chul-Woo Han, Anyang-shi (KR)--

Signed and Sealed this

Third Day of July, 2007

JON W. DUDAS
*Director of the United States Patent and Trademark Office*